US012097416B2

(12) United States Patent
Kreppein

(10) Patent No.: US 12,097,416 B2
(45) Date of Patent: Sep. 24, 2024

(54) INDOOR GOLF TEE

(71) Applicant: K2 Golf, LLC, Charlotte, NC (US)

(72) Inventor: Kevin Richard Kreppein, Charlotte, NC (US)

(73) Assignee: K2 Golf, LLC, Charlotte, NC (US)

( * ) Notice: Subject to any disclaimer, the term of this patent is extended or adjusted under 35 U.S.C. 154(b) by 0 days.

(21) Appl. No.: 18/309,789

(22) Filed: Apr. 29, 2023

(65) Prior Publication Data

US 2023/0356047 A1 Nov. 9, 2023

Related U.S. Application Data

(60) Provisional application No. 63/364,071, filed on May 3, 2022.

(51) Int. Cl.

| | |
|---|---|
| ***A63B 57/13*** | (2015.01) |
| ***A63B 57/15*** | (2015.01) |
| ***A63B 67/02*** | (2006.01) |
| ***A63B 71/04*** | (2006.01) |

(52) U.S. Cl.

CPC ..... *A63B 57/13* (2015.10); *A63B 57/15* (2015.10); *A63B 71/04* (2013.01); *A63B 67/02* (2013.01)

(58) Field of Classification Search

CPC ..... A63B 57/13; A63B 57/15; A63B 71/04; A63B 67/02; A63B 57/12; A63B 57/10

See application file for complete search history.

(56) References Cited

U.S. PATENT DOCUMENTS

| | | | | | |
|---|---|---|---|---|---|
| 648,956 | A * | 5/1900 | Herrick | A63B 57/12 | D21/717 |
| 654,666 | A * | 7/1900 | Newton | A63B 57/10 | 473/394 |
| 1,696,136 | A * | 12/1928 | Coburn | A63B 57/12 | 473/401 |
| 1,803,907 | A * | 5/1931 | Kruse | A63B 57/10 | D21/717 |
| 1,823,992 | A * | 9/1931 | Smith | A63B 57/10 | 473/394 |

(Continued)

FOREIGN PATENT DOCUMENTS

| | | | | |
|---|---|---|---|---|
| FR | 2929529 | A3 * | 10/2009 | A63B 57/10 |
| GB | 170476 | A * | 9/1920 | |

(Continued)

*Primary Examiner* — Steven B Wong

(74) *Attorney, Agent, or Firm* — Jeffrey C. Watson, Esq.; Grell & Watson Patent Attorneys LLC

(57) ABSTRACT

An indoor golf tee includes a tee base and a tee shaft. The tee base has a base top portion and a base bottom portion. The base top portion has a connecting hole therethrough. The tee shaft has a shaft top portion, a shaft bottom portion, and a shaft body. The shaft body is connected between the shaft bottom portion and the shaft top portion. The shaft top portion is configured to hold a golf ball thereon. The shaft bottom portion is removably connected in the connecting hole of the tee base in a perpendicular orientation to the tee base. When the base bottom portion of the tee base is positioned on a surface, and the shaft bottom portion is connected in the connecting hole of the base top portion, the tee base orients the tee shaft in the perpendicular orientation to the surface.

16 Claims, 10 Drawing Sheets

(56) References Cited

U.S. PATENT DOCUMENTS

| | | | | | |
|---|---|---|---|---|---|
| 2,457,670 | A * | 12/1948 | Harvey | A63B 57/12 | 473/394 |
| 3,406,977 | A * | 10/1968 | Voelkerding | A63B 57/10 | 473/257 |
| 3,690,676 | A * | 9/1972 | Frank Costa | A63B 57/10 | 473/398 |
| D306,751 | S * | 3/1990 | Orton | D21/717 | |
| 5,156,403 | A * | 10/1992 | Martino | A63B 57/10 | 473/278 |
| 6,328,663 | B1 * | 12/2001 | Lipstock | A63B 57/10 | 473/396 |
| 8,926,331 | B1 * | 1/2015 | Schlapik | A63B 43/007 | 434/219 |
| 9,737,773 | B2 * | 8/2017 | Ciasullo | A63B 57/15 | |
| 2006/0035727 | A1 * | 2/2006 | Butterworth | A63B 57/13 | 473/387 |
| 2008/0102988 | A1 * | 5/2008 | Sagadevan | A63B 57/10 | 473/397 |
| 2009/0137345 | A1 * | 5/2009 | Sagadevan | A63B 57/15 | 473/387 |
| 2009/0325726 | A1 * | 12/2009 | Humphrey | A63B 57/10 | 473/278 |
| 2012/0214616 | A1 * | 8/2012 | Lipstock | A63B 57/10 | 473/396 |
| 2017/0106258 | A1 * | 4/2017 | Rost | A63B 57/10 | |

FOREIGN PATENT DOCUMENTS

| | | | | |
|---|---|---|---|---|
| GB | 2327193 | A * | 1/1999 | A63B 57/10 |
| KR | 102390650 | B1 * | 4/2022 | |

* cited by examiner

INDOOR GOLF TEE

CROSS-REFERENCE TO RELATED APPLICATIONS

This application claims benefit to U.S. Provisional Patent Application No. 63/364,071 filed on May 3, 2022, entitled "Indoor Golf Tee", which is incorporated by reference in its entirety.

FIELD OF THE DISCLOSURE

The present disclosure relates to golf and golf equipment. More particularly, the present disclosure is related to an indoor golf tee.

BACKGROUND

Generally speaking, a tee is a stand used in sport to support and elevate a stationary ball prior to striking with a foot, club or bat. Tees are used extensively in golf, tee-ball, baseball, American football, and rugby. In golf, a tee is normally used for the first stroke of each hole. The area from which this first stroke is hit is in the rules known as the teeing ground. Normally, teeing the ball is allowed only on the first shot of a hole, called the tee shot, and is illegal for any other shot. However, local or seasonal rules may allow or require teeing for other shots as well, like under "winter rules" to protect the turf when it is unusually vulnerable. Teeing gives a considerable advantage for drive shots, so it is normally done whenever allowed. However, players may elect to play their tee shots without a tee. This typically gives the shot a lower trajectory.

A standard golf tee is 2.125" (two and one eighth inches=5.4 cm) long, but both longer and shorter tees are permitted. Ordinary tees can be made from wood or from durable plastic. There are also many biodegradable and recyclable golf tees that diminish the number of trees cut down to manufacture the tees and allow golf courses to lower costs by not having to deal with the broken wooden tees on their courses. According to the R&A and USGA rules of golf, for a tee to be legal, "It must not be longer than 4 inches (101.6 mm) and it must not be designed or manufactured in such a way that it could indicate the line of play or influence the movement of the ball."

One tool that is growing in popularity in the golfing world is a launch monitor. A launch monitor is a device that measures various parameters related to the club and ball at impact. Some of the most common measurements include carry distance, spin, ball speed, and club head speed. At its core, a launch monitor gives you numbers after each shot, although many launch monitors allow software simulation. As such, a launch monitor can be used alone or it can be the primary component of a golf simulator because it is what takes the measurements. A golf simulator is a high-tech system that enables you to practice golf indoors in a virtually simulated golf environment. It is a computerized golf setup designed to mimic the real game, helping you analyze your swing, understand your weaknesses, and improve your game without having to go to your local course.

Regardless of whether you are using the launch monitor alone or in conjunction with a golf simulator, if you are using the launch monitor indoors or on an artificial mat outdoors, one thing that is needed is an indoor golf tee that is designed to be used on such artificial mats.

The instant disclosure may be designed to address at least certain aspects of the problems or needs discussed above by providing an indoor golf tee.

SUMMARY

The present disclosure may solve the aforementioned limitations of the currently available golf tees, by providing an indoor golf tee. The indoor golf tee may generally include a tee base and a tee shaft. The tee base may have a base top portion and a base bottom portion. The base top portion may have a connecting hole therethrough. The tee shaft may have a shaft top portion, a shaft bottom portion, and a shaft body. The shaft body may be connected between the shaft bottom portion and the shaft top portion. The shaft top portion may be configured to hold a golf ball thereon. The shaft bottom portion may be removably connected in the connecting hole of the tee base in a perpendicular orientation to the tee base.

One feature of the disclosed indoor golf tee may be that when the base bottom portion of the tee base is positioned on a surface, and the shaft bottom portion is connected in the connecting hole of the base top portion, the tee base may orient the tee shaft in the perpendicular orientation to the surface.

Another feature of the disclosed indoor golf tee may be that the shaft top portion is configured to hold the golf ball in a vertical position above the surface. Whereby, with the golf ball held in a vertical position above the surface, the indoor golf tee may be designed and configured for indoor simulation golf.

Another feature of the disclosed indoor golf tee may be that a height of the tee shaft may be adjustable from the tee base. In select embodiments, the height of the tee shaft may be adjustable from the tee base by sliding the shaft bottom portion further into and out of the connecting hole of the tee base.

Another feature of the disclosed indoor golf tee may be that the shaft bottom portion of the tee shaft may include at least one positioning groove. Each of the at least one positioning grooves may be configured to provide a set height of the tee shaft from the tee base when the connecting hole of the tee base is positioned in the positioning groove.

Another feature of the disclosed indoor golf tee may be that on a distal end of the shaft bottom portion a protruding bottom surface may be included. The protruding bottom surface may have a bottom radius bigger than a body radius of the shaft body. The protruding bottom surface of the tee shaft may be configured to provide an extended height of the tee shaft from the tee base when slid up and positioned under the connecting hole.

In select embodiments of the disclosed indoor golf tee, the shaft bottom portion may include a positioning groove and the distal end of the shaft bottom portion may include the protruding bottom surface. The positioning groove may be configured to provide the set height of the tee shaft from the tee base when the connecting hole of the tee base is positioned in the positioning groove. The protruding bottom surface may have a bottom radius bigger than a body radius of the shaft body. The protruding bottom surface of the tee shaft may be configured to provide an extended height of the tee shaft from the tee base when slid up and positioned under the connecting hole. Whereby, in these select embodiments, the height of the tee shaft may be adjustable between the set height and the extended height.

Another feature of the disclosed indoor golf tee may be that the tee shaft may include an incremental distance between the set height and the extended height. In select embodiments, the incremental distance may be, but is not limited to, 0.25 inches.

Another feature of the disclosed indoor golf tee may be that the height of the tee shaft may be provided in different sizes. These different sizes of the height of the tee shaft may be, but is not limited to, between 0.75 inches up to 4.00 inches in any various increments. In select possibly preferred embodiments, the inch increments the different sizes of the height of the tee shaft may be, but is not limited to, between 0.75 inches up to 2.75 inches 0.25 inch increments. In select embodiments, the tee shaft of the indoor golf tee may be a number 3 shaft that is adjustable between the set height of 0.75 inches and the extended height of 1.00 inches. In other select embodiments, the tee shaft of the indoor golf tee may be a number 4 shaft that is adjustable between the set height of 1.00 inches and the extended height of 1.25 inches. In other select embodiments, the tee shaft of the indoor golf tee may be a number 5 shaft that is adjustable between the set height of 1.25 inches and the extended height of 1.50 inches. In other select embodiments, the tee shaft of the indoor golf tee may be a number 6 shaft that is adjustable between the set height of 1.50 inches and the extended height of 1.75 inches. In other select embodiments, the tee shaft of the indoor golf tee may be a number 7 shaft that is adjustable between the set height of 1.75 inches and the extended height of 2.00 inches. In other select embodiments, the tee shaft of the indoor golf tee may be a number 8 shaft that is adjustable between the set height of 2.00 inches and the extended height of 2.25 inches. In other select embodiments, the tee shaft of the indoor golf tee may be a number 9 shaft that is adjustable between the set height of 2.25 inches and the extended height of 2.50 inches. In other select embodiments, the tee shaft of the indoor golf tee may be a number X shaft that is adjustable between the set height of 2.50 inches and the extended height of 2.75 inches.

In select embodiments of the disclosed indoor golf tee, the tee base may have a conical shape. The conical shape of the tee base may have an open top being the connecting hole. The base bottom portion may be a rounded flat portion that is larger than the base top portion with the connecting hole. Wherein, the tee base may taper smaller from the base bottom portion to the base top portion.

Another feature of the disclosed indoor golf tee may be that the tee base may include a base height. The base height may be from the base bottom portion to the base top portion. In select embodiments, the tee base may be a standard tee base with a standard base height. In other select embodiments, the tee base may be a low-profile tee base with a low base height. In select embodiments, the standard base height may be, but is not limited to, 0.5 inches. In select embodiments, the low base height may be, but is not limited to, 0.25 inches.

Another feature of the disclosed indoor golf tee may be the inclusion of an attachment mechanism. The attachment mechanism may be configured to attach a weighted bag, or the like, to the indoor golf tee. In select embodiments, the attachment mechanism may be attached to the base bottom portion of the tee base for attaching the weighted bag, or the like, to the tee base. In other select embodiments, the attachment mechanism may include a stem and a diamond attachment portion. The stem may be attached to the indoor golf tee at a first end. The diamond attachment portion may be on a second end of the stem. The diamond attachment portion may be configured for connecting a lanyard, or the like, between the indoor golf tee and the weighted bag. The diamond attachment portion may include a first slit on a first side of the diamond attachment portion, and a second slit on a second side of the diamond attachment portion. Wherein, when a looped end of a lanyard is looped around the diamond attachment portion and onto the stem and then pulled over the diamond attachment portion, a first side piece may be configured to compress to allow the looped end to enter the first slit on the first side of the diamond attachment portion, and a second side piece may be configured to compress to allow the looped end to enter the second slit on the second side of the diamond attachment portion. Wherein the weighted bag, or the like, may be attached to the indoor golf tee via a lanyard. In select embodiments, the lanyard may include a swiveled connection between the weighted bag and the indoor golf tee. The swiveled connection may be configured to prevent the lanyard from twisting. In select embodiments, the lanyard may be connected to the weighted bag via a D-ring connector attached on a corner of the weighted bag. Wherein, when the weighted bag is attached to the indoor golf tee via the lanyard, the weighted bag may be configured to prevent the indoor golf tee from being hit farther away from the weighted bag than a length of the lanyard.

Another feature of the disclosed indoor golf tee may be that it can be a 2-part tee. The 2-part tee feature of the indoor golf tee may be created where the tee base is configured to be assembled with the tee shaft. Wherein, the indoor golf tee may be configured to allow the tee shaft to be interchanged with the tee base. Whereby the indoor golf tee can be configured with various sized tee shafts or various sized tee bases, or the indoor golf tee can be configured to replace a broken tee shaft by connecting another tee shaft with the tee base.

Another feature of the disclosed indoor golf tee may be that the tee shaft may be smaller than a golf ball. With this feature, the indoor golf tee can be designed and configured not to interfere with a golf club before impact when used as a golf tee.

In another aspect, the instant disclosure embraces the indoor golf tee in any of the various embodiments and/or combinations of embodiments shown and/or described herein.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-9, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Figure 1:
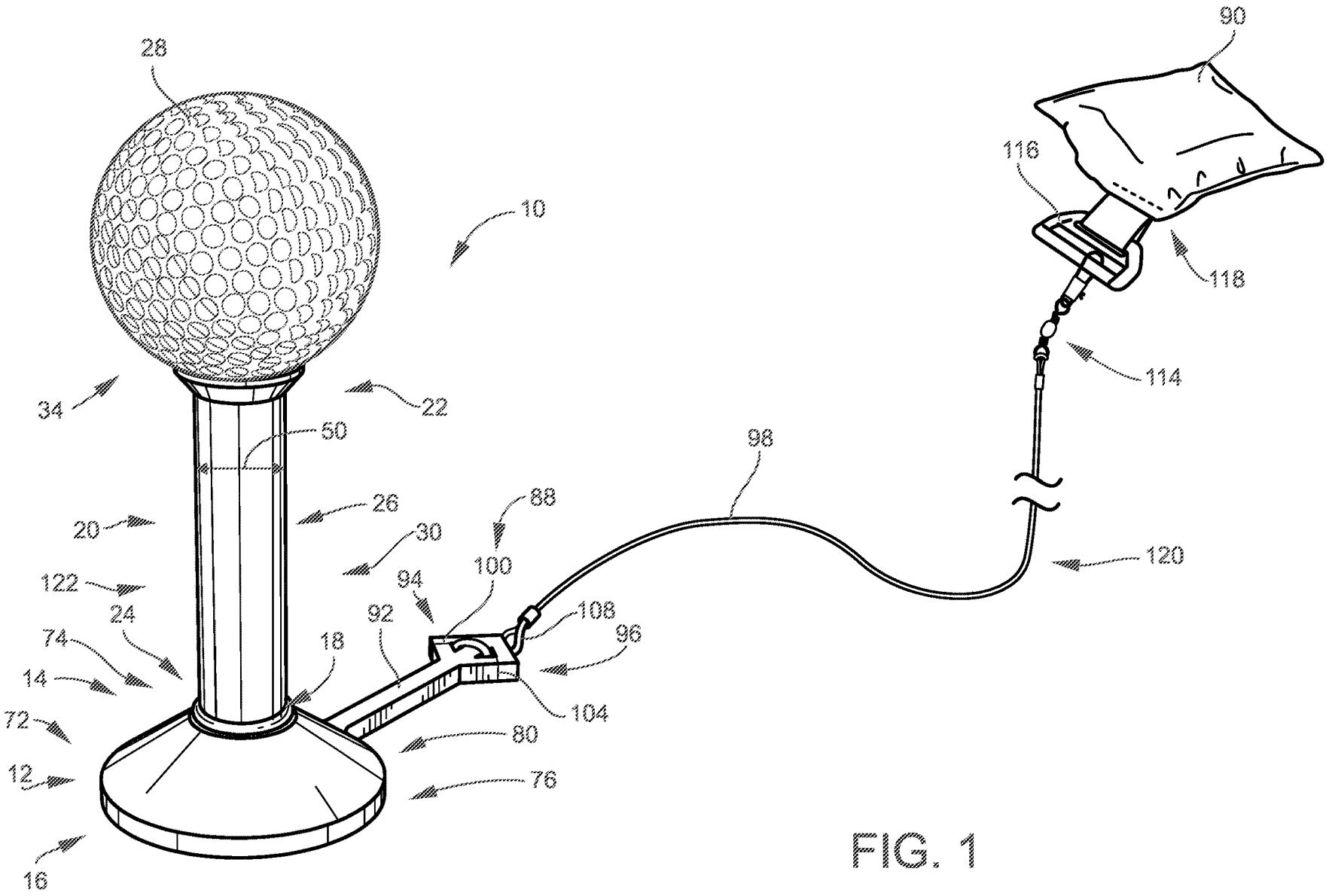
FIG. 1 is a perspective view of the indoor tee according to select embodiments of the instant disclosure with a golf ball positioned on the tee and a weighted bag attached to the indoor golf tee.

Referring to FIGS. 1-9, the present disclosure may solve the aforementioned limitations of the currently available golf tees by providing the disclosed indoor golf tee 10. indoor golf tee 10 may generally include tee base 12 and tee shaft 20. Tee base 12 may be for providing a wide enough surface to support tee shaft 20 with a golf ball thereon in perpendicular orientation 30. Tee base 12 may have base top portion 14 and base bottom portion 16. Base top portion 14 may have connecting hole 18 therethrough (see FIGS. 3A, 3B). Tee shaft 20 may have shaft top portion 22, shaft bottom portion 24, and shaft body 26. Shaft body 26 may be connected between shaft bottom portion 24 and shaft top portion 22. Shaft top portion 22 may be configured to hold golf ball 28 thereon, as shown in FIG. 1. Shaft top portion 22 may include a shape, size and/or configuration similar to standard golf tees, or the like, for holding golf ball 28 thereon. Shaft bottom portion 24 may be removably connected in connecting hole 18 of tee base 12 in perpendicular orientation 30 to tee base 12.

Figure 9:
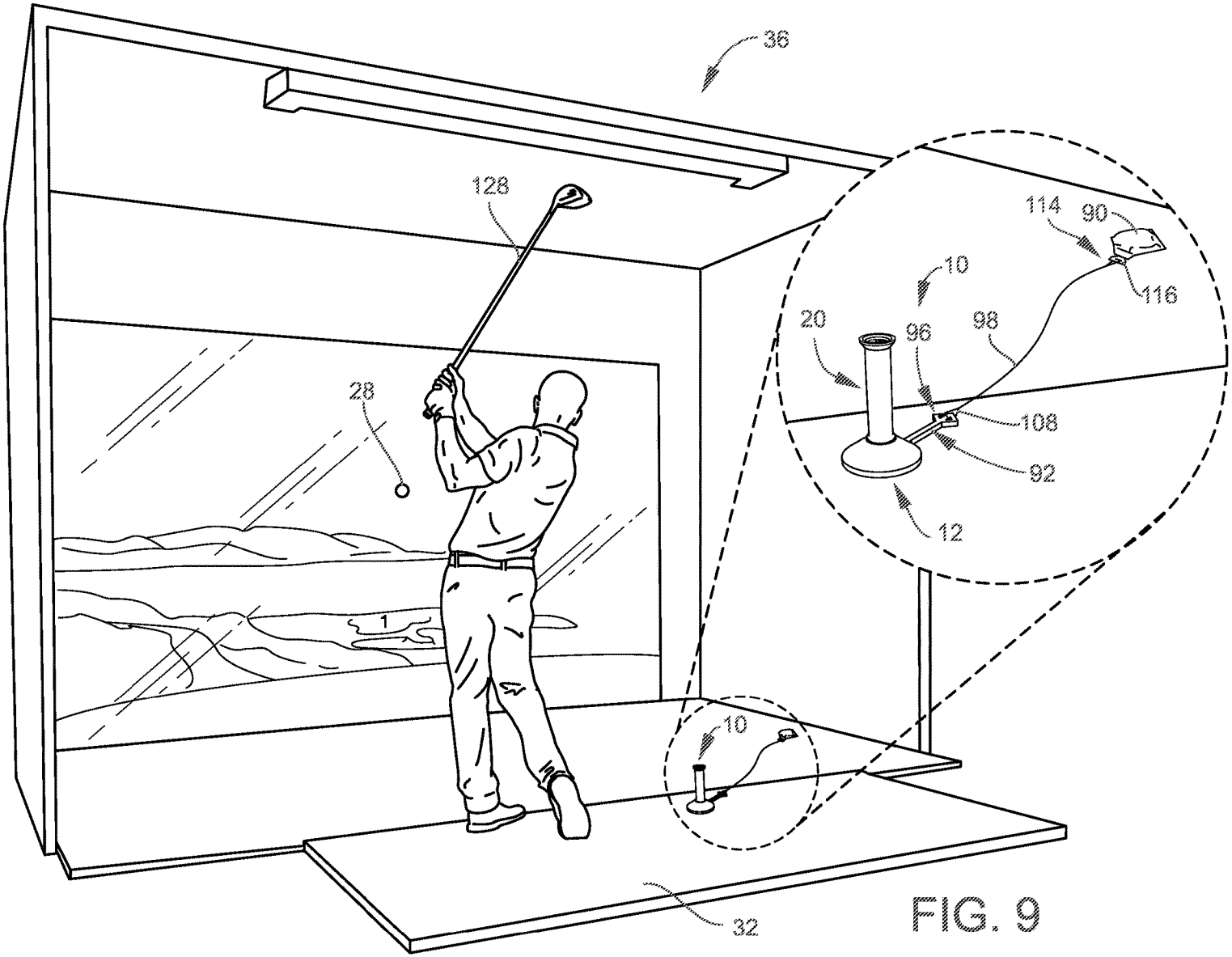
FIG. 9 is an environmental perspective view of the indoor golf tee according to select embodiments of the instant disclosure in use by a golfer positioned on an artificial mat with a weighted bag attached to the tee base via the lanyard.

As shown in FIG. 9, one feature of indoor golf tee 10 may be that when base bottom portion 16 of tee base 12 is positioned on surface 32 (like the ground, a hitting mat, the like, etc.), and shaft bottom portion 24 is connected in connecting hole 18 of base top portion 14, tee base 12 may orient tee shaft 20 in perpendicular orientation 30 to surface 32.

As best shown in FIG. 1, another feature of indoor golf tee 10 may be that shaft top portion 22 may be configured to hold golf ball 28 in vertical position 34 above surface 32. Whereby, with golf ball 28 held in vertical position 34 above surface 32, indoor golf tee 10 may be designed and configured for indoor simulation golf 36, as shown in FIG. 9.

Referring now to FIGS. 3-8, another feature of indoor golf tee 10 may be that height 38 of tee shaft 20 may be adjustable from tee base 12. In select embodiments, height 38 of tee shaft 20 may be adjustable from tee base 12 by sliding shaft bottom portion 24 further into and out of connecting hole 18 of tee base 12. As best shown in FIGS. 6A and 6B, a user may push on protruding bottom surface 46 on the bottom of indoor golf tee 10 while holding tee base 12. This force may move shaft bottom portion 24 further into connecting hole 18 for extending height 38 of tee shaft 20, thereby providing a longer version of indoor golf tee 10.

Figure 4A:
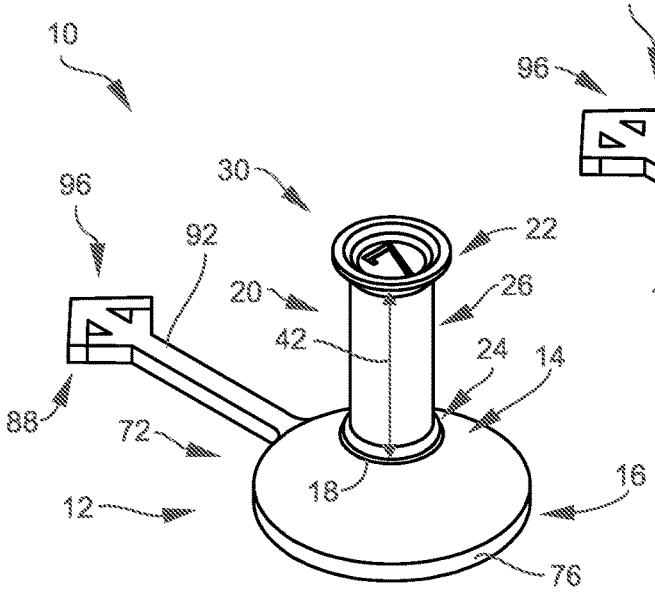
FIG. 4A is a top perspective view of the indoor golf tee of FIG. 1 in the lowered position.
Figure 4B:
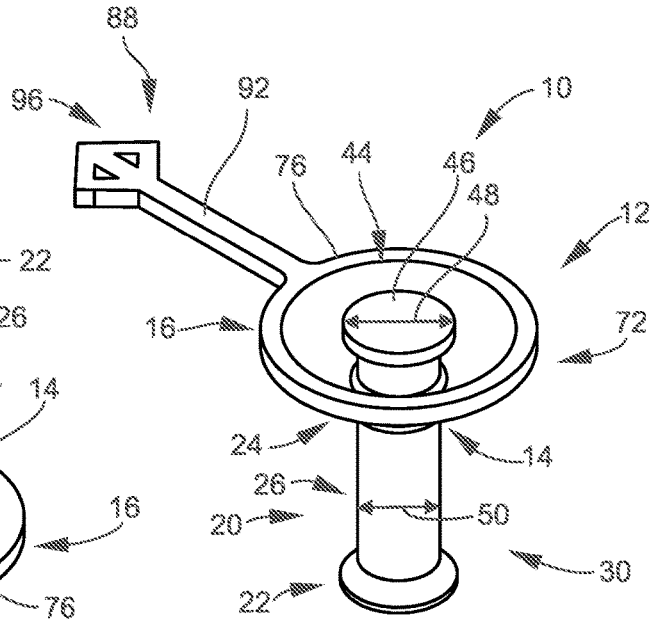
FIG. 4B is a bottom perspective view of the indoor golf tee of FIG. 1 in the lowered position.
Figure 4C:
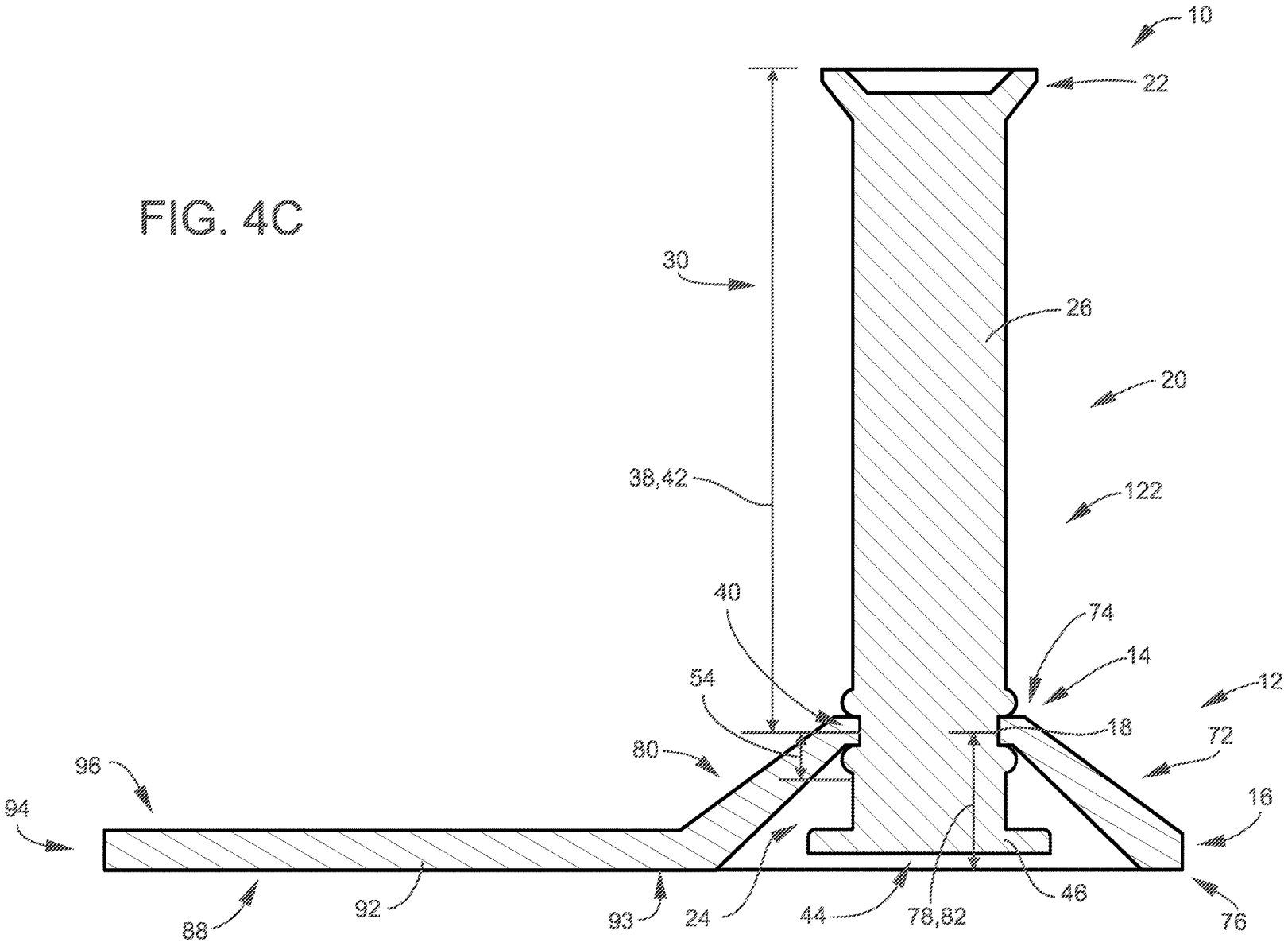
FIG. 4C is a cross-sectional side view of the indoor golf tee of FIG. 1 in the lowered position.
Figures 5A, 5B:
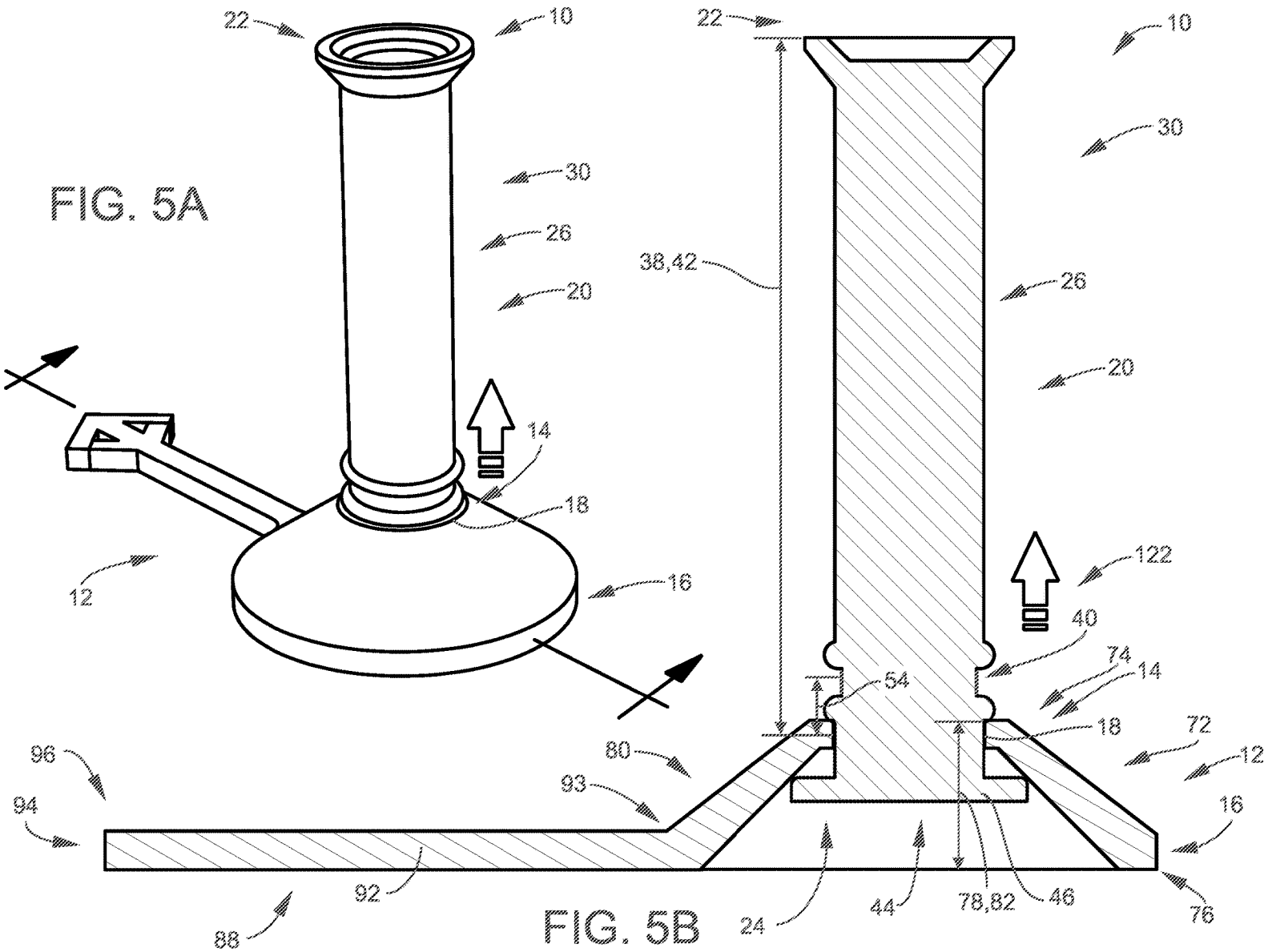
FIG. 5A is a top perspective view of the indoor golf tee of FIG. 1 in the raised position.
FIG. 5B is a cross-sectional side view of the indoor golf tee of FIG. 1 in the raised position.
Figure 6A:
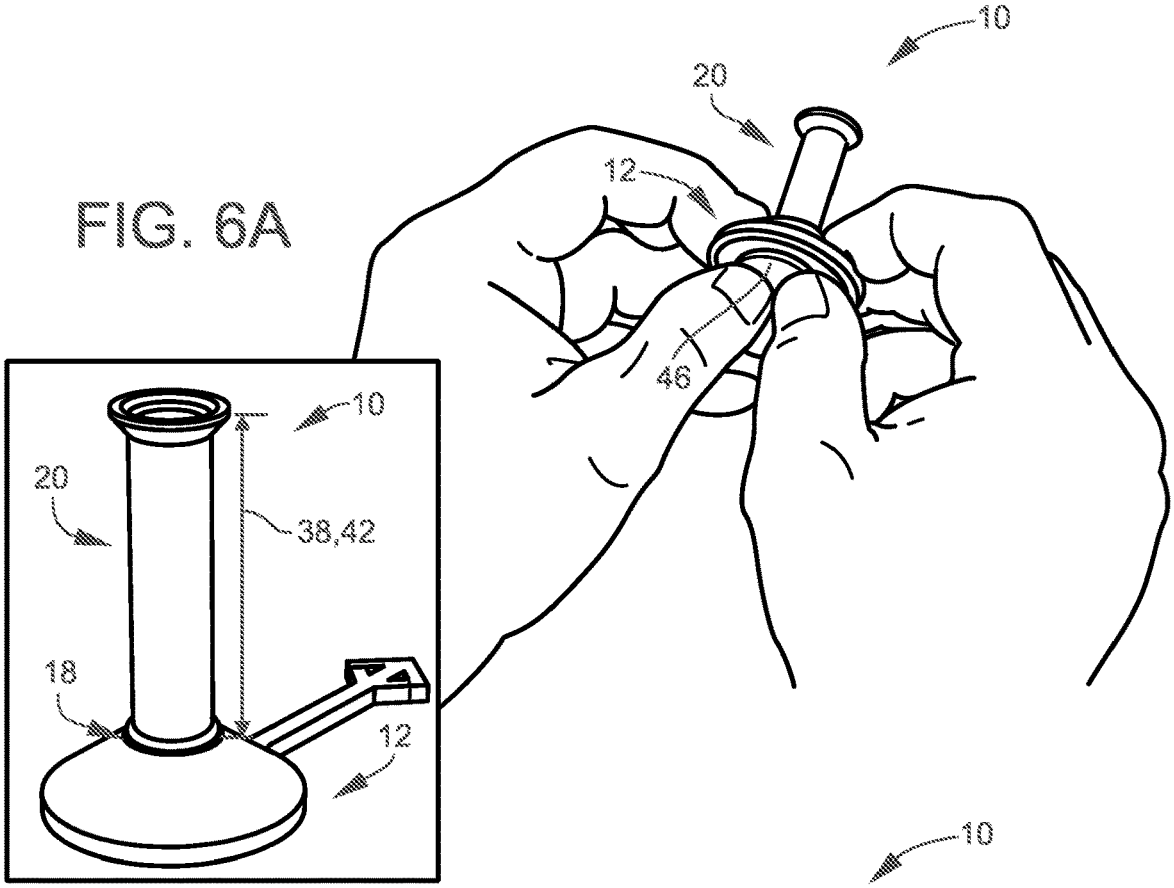
FIG. 6A is an environmental perspective view of the indoor golf tee of FIG. 1 in the lowered position and showing a user positioning their fingers to raise the indoor golf tee to the raised position.
Figure 6B:
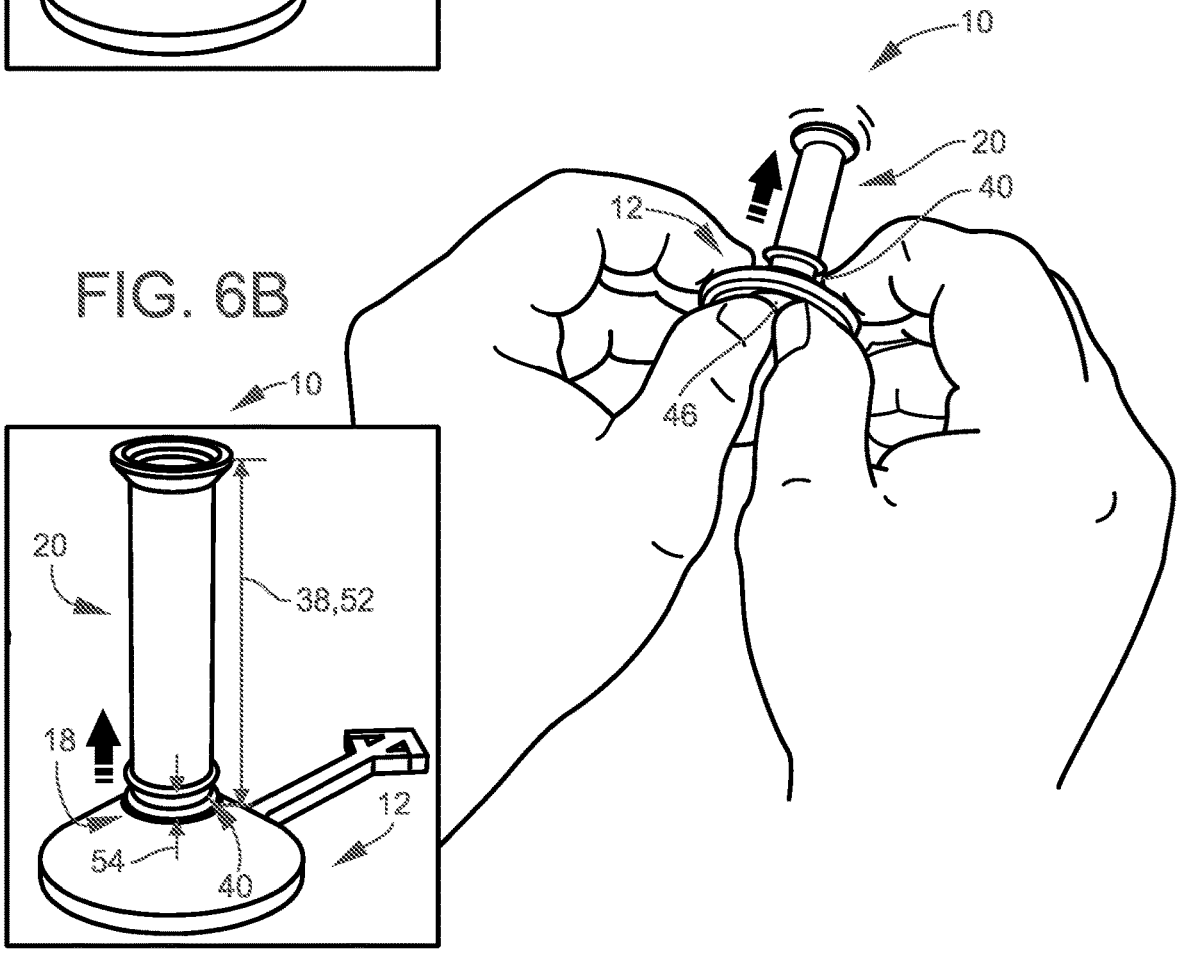
FIG. 6B is an environmental perspective view of the indoor golf tee of FIG. 1 in the raised position and showing a user with their fingers in position after raising the indoor golf tee to the raised position.

As best shown in FIGS. 4C and 5B, another feature of indoor golf tee 10 may be that shaft bottom portion 24 of tee shaft 20 may include at least one positioning groove 40. Each of the at least one positioning grooves 40 may be configured to provide set height 42 of tee shaft 20 from tee base 12 when connecting hole 18 of tee base 12 is positioned in one of the positioning grooves 40, as shown in FIGS. 4C and 5B.

As best shown in FIGS. 4C and 5B, another feature of indoor golf tee 10 may be that on distal end 44 of shaft bottom portion 24, protruding bottom surface 46 may be included. Protruding bottom surface 46 may have bottom radius 48 bigger than body radius 50 of shaft body 26. Protruding bottom surface 46 of tee shaft 20 may be configured to provide extended height 52 of tee shaft 20 from tee base 12 when slid up and positioned under connecting hole 18, as shown in FIGS. 4C and 5B.

Still referring to FIGS. 4C and 5B, in select embodiments of indoor golf tee 10, shaft bottom portion 24 may include a single positioning groove 40 thereon, and distal end 44 of shaft bottom portion 24 may include protruding bottom surface 46 thereon. Positioning groove 40 may be configured to provide set height 42 of tee shaft 20 from tee base 12 when connecting hole 18 of tee base 12 is positioned in positioning groove 40. Protruding bottom surface 46 may have bottom radius 48 bigger than body radius 50 of shaft body 26. Protruding bottom surface 46 of tee shaft 20 may be configured to provide extended height 52 of tee shaft 20 from tee base 12 when slid up and positioned under connecting hole 18. Whereby, in these select embodiments, height 38 of tee shaft 20 may be adjustable between set height 42 and extended height 52. In select embodiments, tee shaft 20 may include incremental distance 54 between set height 42 and extended height 52. This incremental distance 54 may be any desired distance between set height 42 and extended height 52. In select embodiments, incremental distance 54 may be, but is not limited to, 0.25 inches. This may allow indoor golf tee 10 to be adjustable between 2 different heights that are 0.25 inches apart.

Figure 7:
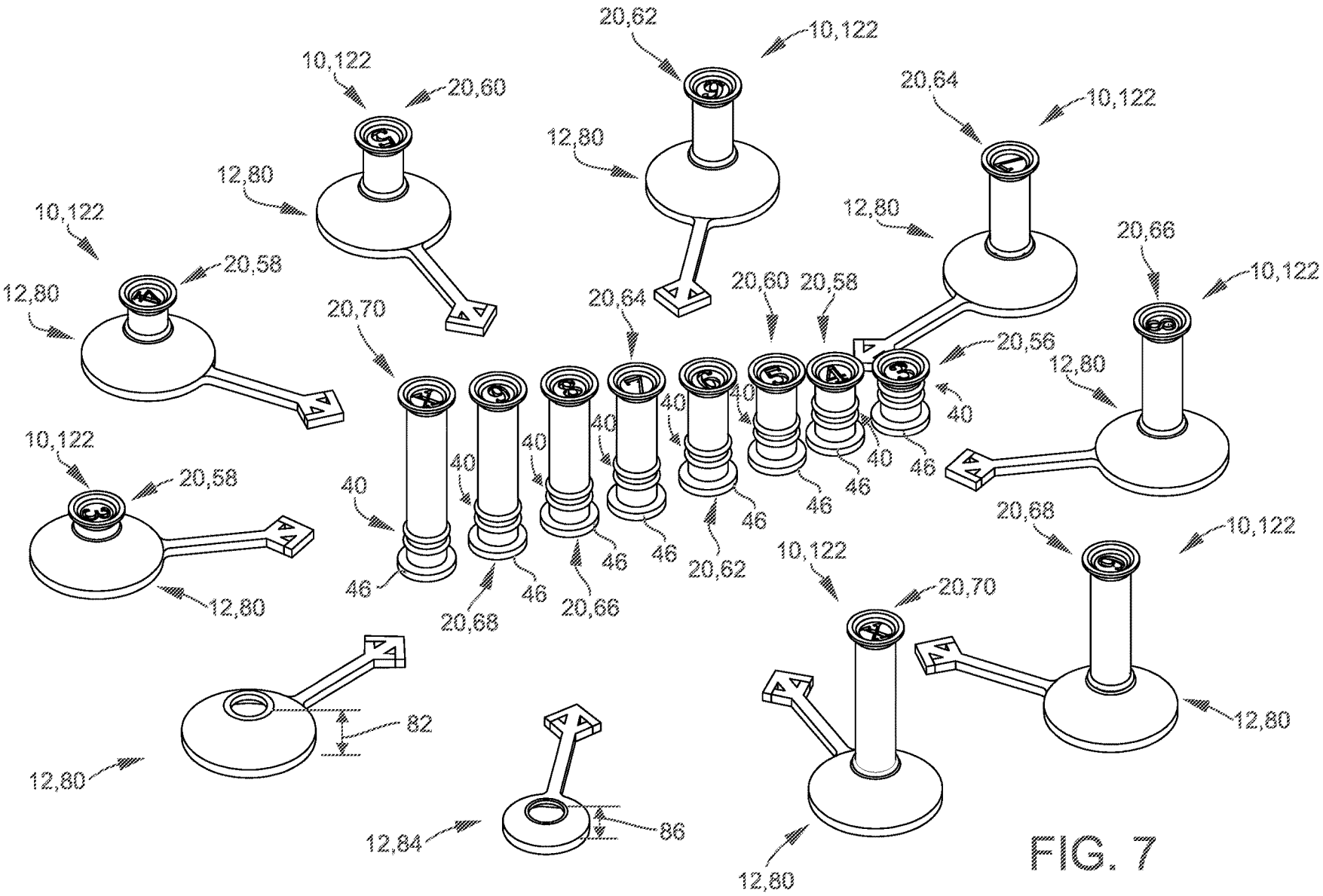
FIG. 7 is a perspective view of a plurality of indoor golf tees according to select embodiments of the instant disclosure showing different embodiments of tee base sizes and different embodiments of tee shaft heights.
Figure 8A:
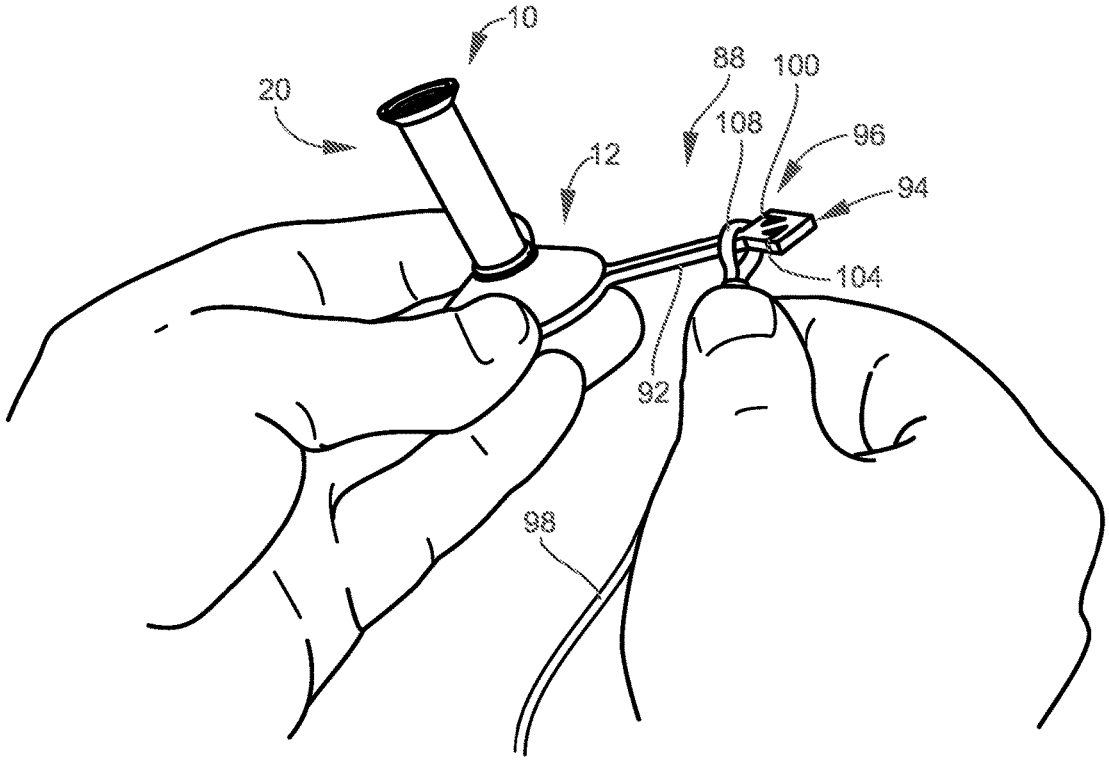
FIG. 8A is an environmental perspective view of the indoor golf tee according to select embodiments of the instant disclosure showing a user positioning the loop of the lanyard for the weighted bag around the diamond attachment portion and onto the stem for the diamond attachment portion.
Figure 8B:
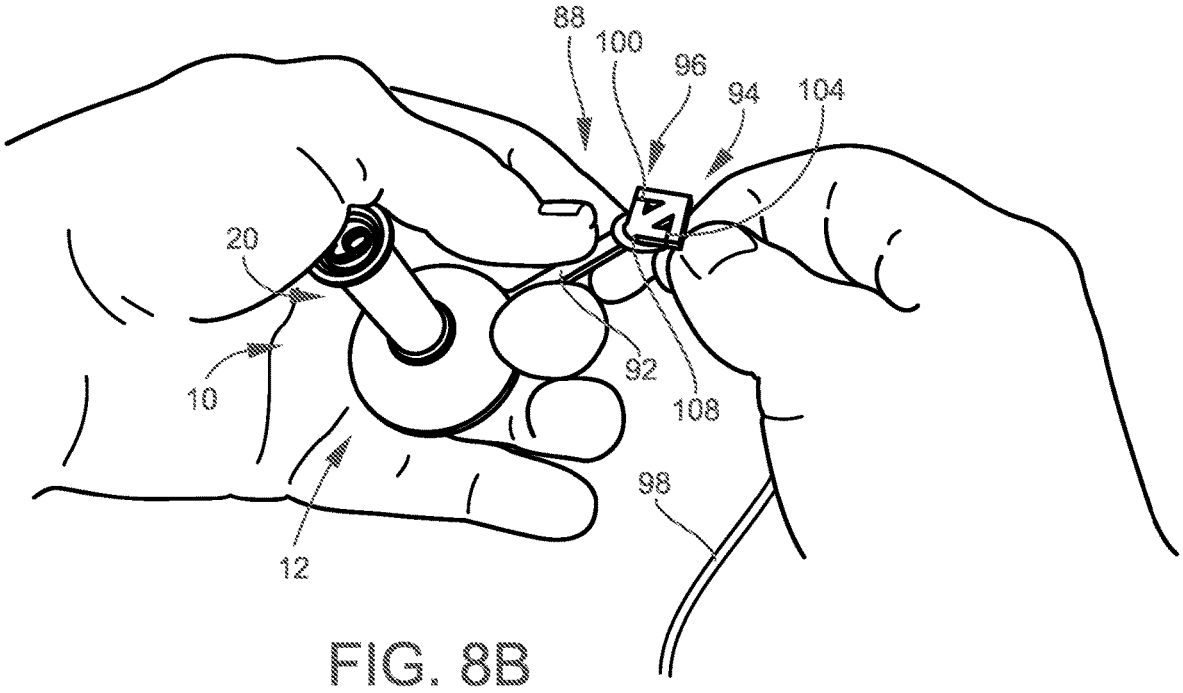
FIG. 8B is another environmental perspective view of the indoor golf tee of FIG. 8A showing a user beginning to pull the lanyard thereby moving the loop of the lanyard down the stem for the diamond attachment portion and onto the diamond attachment portion.
Figure 8D:
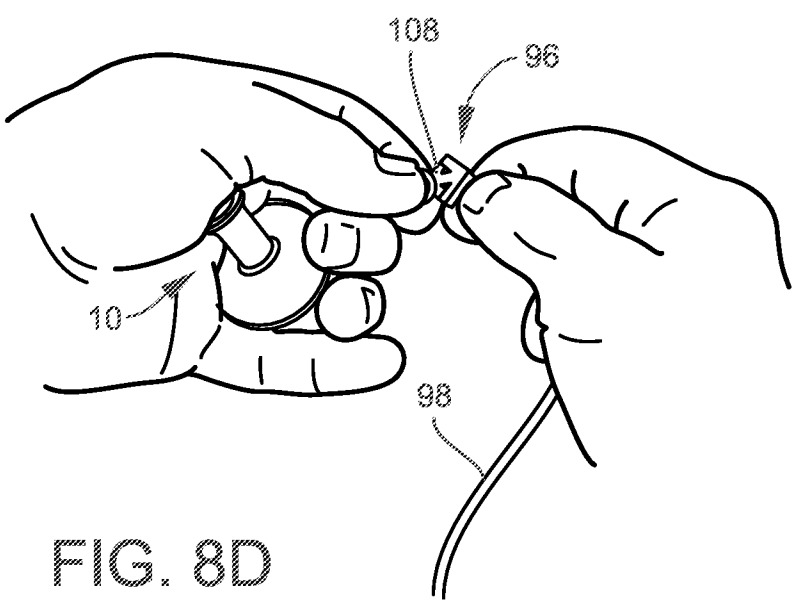
FIG. 8D is another environmental perspective view of the indoor golf tee of FIG. 8A showing a user continuing to pull the lanyard thereby moving the loop of the lanyard onto the diamond attachment portion.
Figure 8C:
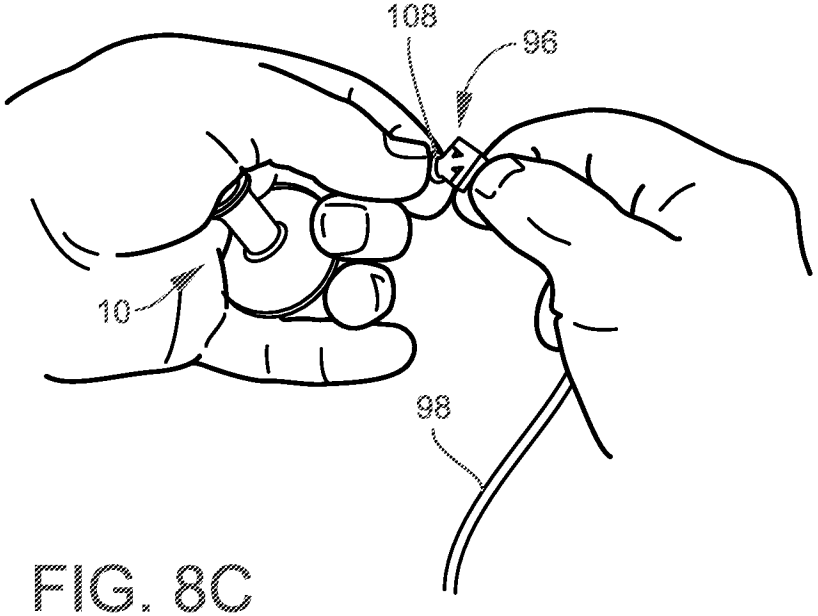
FIG. 8C is another environmental perspective view of the indoor golf tee of FIG. 8A showing a user continuing to pull the lanyard thereby moving the loop of the lanyard onto the diamond attachment portion.
Figure 8E:
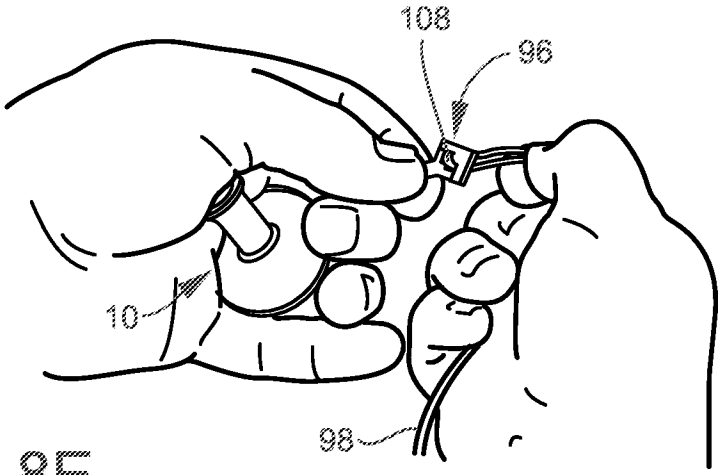
FIG. 8E is another environmental perspective view of the indoor golf tee of FIG. 8A showing a user with their fingers in position after attaching the lanyard to the diamond attachment portion.

Referring now to FIG. 7, another feature of indoor golf tee 10 may be that height 38 of tee shaft 20 may be provided in different sizes. Height 38 of tee shaft 20 may be provided in any desired size or height. These different sizes of height 38 of tee shaft 20 may be, but is not limited to, between 0.75 inches up to 4.00 inches in any various increments. In select possibly preferred embodiments, these different sizes of height 38 of tee shaft 20 may be, but are not limited to, between 0.75 inches up to 2.75 inches (or greater) in 0.25 inch increments. In select embodiments, tee shaft 20 of indoor golf tee 10 may be number 3 shaft 56 that is adjustable between set height 42 of 0.75 inches and extended height 52 of 1.00 inches. In other select embodiments, tee shaft 20 of indoor golf tee 10 may be number 4 shaft 58 that is adjustable between set height 42 of 1.00 inches and extended height 52 of 1.25 inches. In other select embodiments, tee shaft 20 of indoor golf tee 10 may be number 5 shaft 60 that is adjustable between set height 42 of 1.25 inches and extended height 52 of 1.50 inches. In other select embodiments, tee shaft 20 of indoor golf tee 10 may be number 6 shaft 62 that is adjustable between set height 42 of 1.50 inches and extended height 52 of 1.75 inches. In other select embodiments, tee shaft 20 of indoor golf tee 10 may be number 7 shaft 64 that is adjustable between set height 42 of 1.75 inches and extended height 52 of 2.00 inches. In other select embodiments, tee shaft 20 of indoor golf tee 10 may be number 8 shaft 66 that is adjustable between set height 42 of 2.00 inches and extended height 52 of 2.25 inches. In other select embodiments, tee shaft 20 of indoor golf tee 10 may be number 9 shaft 68 that is adjustable between set height 42 of 2.25 inches and extended height 52 of 2.50 inches. In other select embodiments, tee shaft 20 of indoor golf tee 10 may be number X shaft 70 that is adjustable between set height 42 of 2.50 inches and extended height 52 of 2.75 inches. As shown in the Figures, tee shaft 20 of indoor golf tee 10 may be labeled with the appropriate marking for determining which size or length of tee shaft 20 it is. As exampled, and clearly not limited thereto, each tee shaft 20 may be marked on shaft top portion 22 for viewing of the marking while putting golf ball 28 on shaft top portion 22. These markings may be numbers, like 3, 4, 5, 6, 7, 8, 9, X, for indicating the size or length of tee shaft 20. Tee shaft 20 may be made from various materials, including, but not limited to various plastics and rubbers.

Tee base 12 may be included with indoor golf tee 10. Tee base 12 may be various shapes, sizes and/or or configurations for supporting tee shaft 20 in perpendicular orientation 30. As shown in the Figures, in select embodiments of indoor golf tee 10, tee base 12 may have conical shape 72. Conical shape 72 of tee base 12 may have open top 74 being connecting hole 18. Base bottom portion 16 may be rounded flat portion 76 that is larger than base top portion 14 with connecting hole 18. Wherein, tee base 12 may taper smaller from base bottom portion 16 to base top portion 14. Tee base 12 may be made from various materials, including, but not limited to various plastics and rubbers. Another feature of indoor golf tee 10 may be that tee base 12 may include base height 78. Base height 78 may be from base bottom portion 16 to base top portion 14. As shown in FIG. 7, in select embodiments, tee base 12 may be standard tee base 80 with standard base height 82. In other select embodiments, tee base 12 may be low-profile tee base 84 with low base height 86. In select embodiments, standard base height 82 of standard tee base 80 may be, but is not limited to, 0.5 inches. In other select embodiments, low base height 86 of low-profile tee base 84 may be, but is not limited to, 0.25 inches. With these examples, switching from standard tee base 80 to low-profile tee base 84, or vice versa, may raise or lower the length or height of indoor golf tee 10 by 0.25 inches.

Figures 2A, 2B, 2C, 2D, 2E:
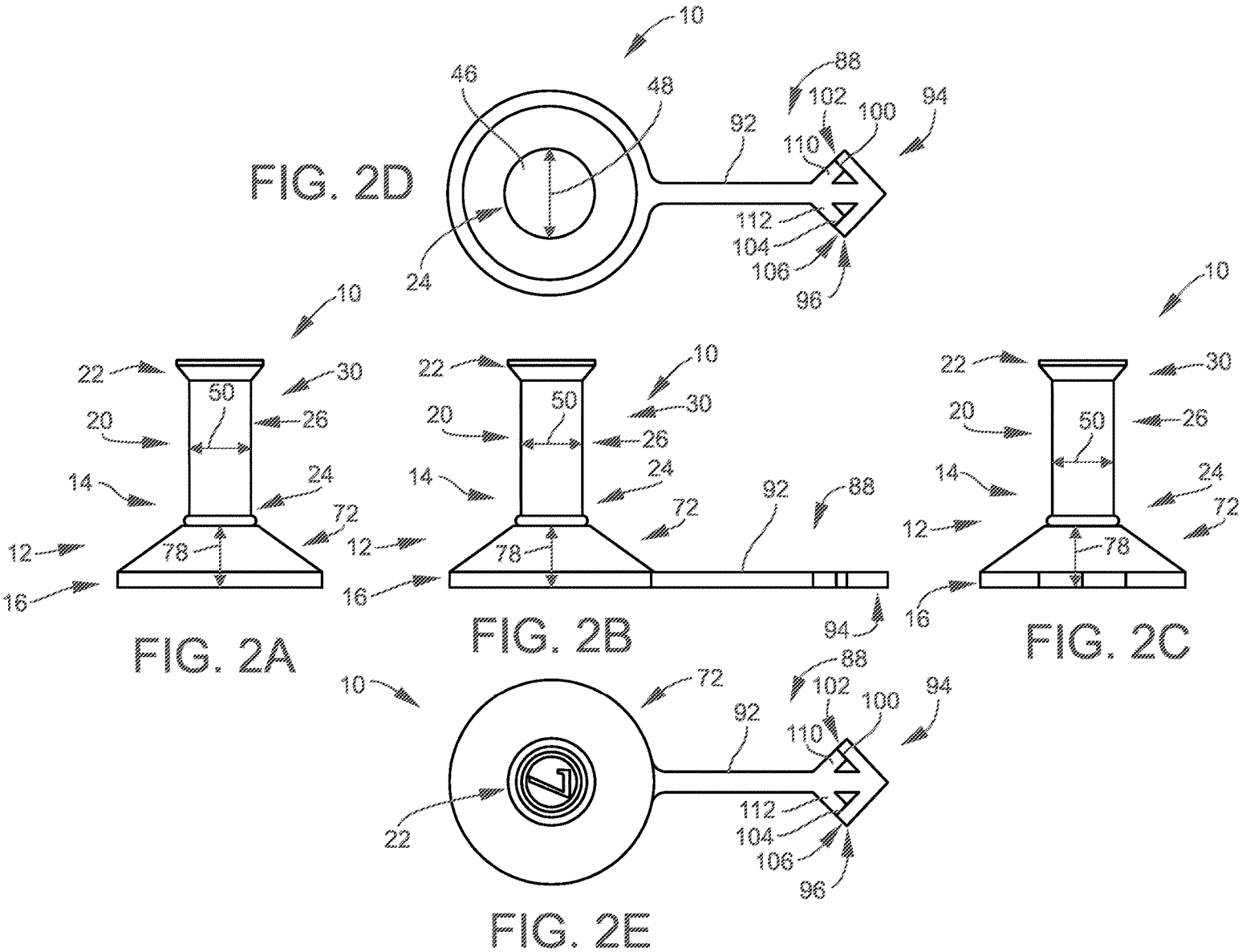
FIG. 2A is a front view of the indoor golf tee according to select embodiments of the instant disclosure.
FIG. 2B is a right side view of the indoor golf tee of FIG. 1, where a left side view would be a mirror image of the right side view shown.
FIG. 2C is a back view of the indoor golf tee of FIG. 1.
FIG. 2D is a bottom view of the indoor golf tee of FIG. 1.
FIG. 2E is a top view of the indoor golf tee of FIG. 1.
Figure 3A:
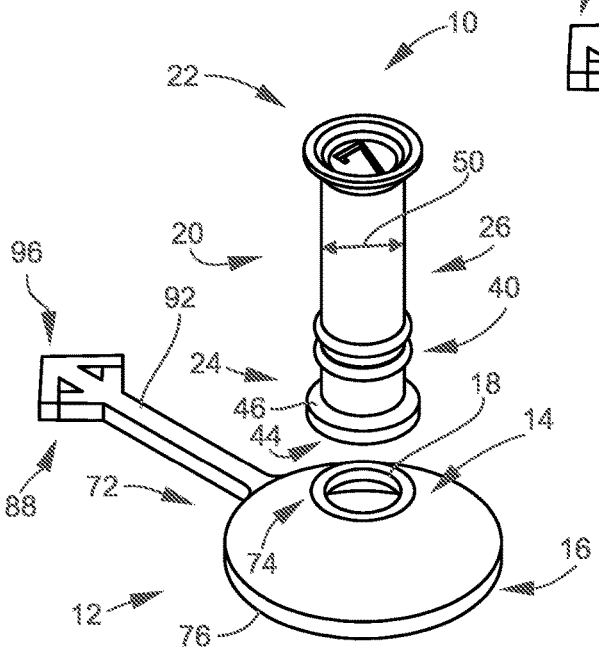
FIG. 3A is a top perspective partially disassembled view of the indoor golf tee of FIG. 1 with the tee base disassembled from the tee shaft.
Figure 3B:
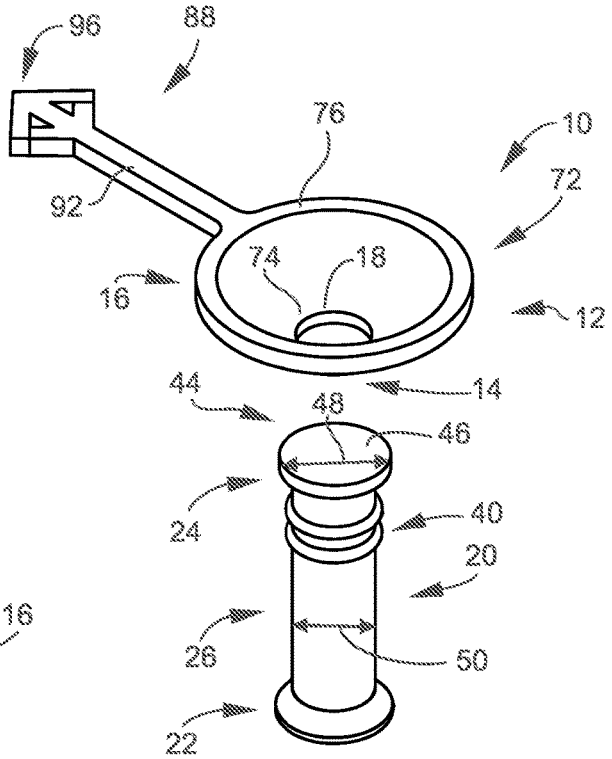
FIG. 3B is a bottom perspective partially disassembled view of the indoor golf tee of FIG. 1 with the tee base disassembled from the tee shaft.

Referring now specifically to FIGS. 1 and 9, another feature of indoor golf tee 10 may be the inclusion of attachment mechanism 88. Attachment mechanism 88 may be configured to attach weighted bag 90, or the like, to indoor golf tee 10. In select embodiments, as shown in the Figures, attachment mechanism 88 may be attached to base bottom portion 16 of tee base 12 for attaching weighted bag 90, or the like, to tee base 12. However, the disclosure is not so limited, and attachment mechanism 88 may be positioned anywhere of indoor golf tee 10. In other select embodiments, as shown in the Figures, attachment mechanism 88 may include stem 92 and diamond attachment portion 96. Stem 92 may be attached to indoor golf tee 10 at first end 93. Diamond attachment portion 96 may be on second end 94 of stem 92. Diamond attachment portion 96 may be configured for connecting lanyard 98, or the like, between indoor golf tee 10 and weighted bag 90, or the like. Lanyard 98 used to connect weighted bag 90 to indoor golf tee 10 may be a bungee cord for providing some shock resistance. Weighted bag 90 may be any weighted device, including, but not limited to, a 5 inch by 5 inch bag filled with sand. As best shown in FIGS. 2D and 2E, diamond attachment portion 96 may include first slit 100 on first side 102 of diamond attachment portion 96, and second slit 104 on a second side of the diamond attachment portion. Wherein, when looped end 108 of lanyard 98 is looped around diamond attachment portion 96 and onto stem 92 (see FIG. 8A) and then pulled over diamond attachment portion 96 (see FIGS. 8B-8C), first side piece 110 may be configured to compress to allow looped end 108 to enter first slit 100 on first side 102 of diamond attachment portion 96, and second side piece 112 may be configured to compress to allow looped end 108 to enter second slit 104 on second side 106 of diamond attachment portion 96 (see FIGS. 8D-8E). When looped end 108 of lanyard 98 is slid into first slit 100 and second slit 104, the looped end 108 of lanyard 98 may be locked onto a middle bar of diamond attachment portion for attaching lanyard 98 to indoor golf tee 10. Wherein weighted bag 90, or the like, may be attached to indoor golf tee 10 via lanyard 98. In select embodiments, lanyard 98 may include swiveled connection 114 between weighted bag 90 and indoor golf tee 10. Swiveled connection 114 may be configured to prevent lanyard 98 from twisting, thereby, causing tension on indoor golf tee 10 that may make it unstable. In select embodiments, lanyard 98 may be connected to weighted bag 90 via D-ring connector 116 attached on corner 118 of weighted bag 90. D-ring connector 116 may be, but is not limited to, a plastic 3 bar ring. Wherein, when weighted bag 90 is attached to indoor golf tee 10 via lanyard 98, weighted bag 90 may be configured to prevent indoor golf tee 10 from being hit farther away from weighted bag 90 than length 120 of lanyard 98.

As shown in FIGS. 1-9, another feature of indoor golf tee 10 may be that it can be 2-part tee 122. This 2-part tee 122 feature of indoor golf tee 10 may be created where tee base 12 is configured to be assembled with tee shaft 20. Wherein, indoor golf tee 10 may be configured to allow various tee shafts 20 to be interchanged with various tee bases 12. Whereby, indoor golf tee 10 can be configured with various sized tee shafts 20 and/or various sized tee bases 12. In addition, indoor golf tee 10 can be configured to replace broken tee shaft 20 by connecting another tee shaft 20 with tee base 12.

Another feature of indoor golf tee 10 may be that tee shaft 20 may be smaller than golf ball 28. With this feature, indoor golf tee 10 can be designed and configured not to interfere with golf club 128 before impact when used as a golf tee, including, but not limited to, like for use in indoor simulation golf 36, as shown in FIG. 9. Tee shaft 20 may be sized smaller than golf ball 28. In select embodiments, shaft body 26 of tee shaft 20 may be approximately half the size of golf ball 28. With In sum, indoor golf tee 10 may be a golf tee designed primarily for indoor simulation golf 36. The disclosed indoor golf tee 10 will seek USGA and RNA (2 governing bodies in golf) approval for outdoor use as well. Each 2-part tee 122 may create a set (tee base 12 and tee shaft 20) that has the ability to be two distinct sizes. (i.e. 0.75" and 1.00"). Indoor golf tee 10 may be provided in, but is not limited to, 8 sizes of tee shaft height (From 0.75" up to 2.00", or higher if desired, in 0.25" increments.

The disclosed indoor golf tee 10 may be 2-part tee 122 that gives the ability to interchange tee shafts 20 in case of breakage or wishing to replace with another size tee shaft 20.

Tee base 12 may be either 0.50" (Standard tee base 80) or 0.25" (low-profile tee base 84).

A distinct advantage of indoor golf tee 10 over existing indoor golf tees may be that tee base 12 and/or tee shaft 20, in any of the various configurations, do not interfere with golf club 128 before impact. The design of indoor golf tee 10 may provide a wide tee base 12 and narrow tee shaft 20 compared to what is on the market so the shaft doesn't get hit first like other indoor golf tees.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. An indoor golf tee comprising:

a tee base with a base top portion and a base bottom portion, the base top portion has a connecting hole therethrough;

a tee shaft, the tee shaft having a shaft top portion, a shaft bottom portion, and a shaft body connected between the shaft bottom portion and the shaft top portion;

the shaft top portion is configured to hold a golf ball thereon;

the shaft bottom portion is removably connected in the connecting hole of the tee base in a perpendicular orientation to the tee base;

an attachment mechanism configured to attach a weighted bag to the indoor golf tee, wherein the attachment mechanism including:

a stem attached to the indoor golf tee at a first end; and a diamond attachment portion on a second end of the stem, the diamond attachment portion is configured for connecting a lanyard between the indoor golf tee and the weighted bag;

wherein the diamond attachment portion including:

a first slit on a first side of the diamond attachment portion;

a second slit on a second side of the diamond attachment portion; and wherein, when a looped end of the lanyard is looped around the diamond attachment portion and onto the stem and then pulled over the diamond attachment portion, a first side piece is configured to compress to allow the looped end to enter the first slit on the first side of the diamond attachment portion, and a second side piece is configured to compress to allow the looped end to enter the second slit on the second side of the diamond attachment portion.

2. The indoor golf tee of claim 1, wherein:

when the base bottom portion of the tee base is positioned on a surface, and the shaft bottom portion is connected in the connecting hole of the base top portion, the tee base orients the tee shaft in the perpendicular orientation to the surface; and the shaft top portion is configured to hold the golf ball in a vertical position above the surface, whereby the indoor golf tee is designed and configured for indoor simulation golf.

3. The indoor golf tee according to claim 1, wherein a height of the tee shaft is adjustable from the tee base.

4. The indoor golf tee according to claim 3, wherein the height of the tee shaft is adjustable from the tee base by sliding the shaft bottom portion further into and out of the connecting hole of the tee base.

5. The indoor golf tee according to claim 4, wherein:

the shaft bottom portion including at least one positioning groove, each of the at least one positioning grooves is configured to provide a set height of the tee shaft from the tee base when the connecting hole of the tee base is positioned in the positioning groove; or a distal end of the shaft bottom portion including a protruding bottom surface with a bottom radius bigger than a body radius of the shaft body, the protruding bottom surface of the tee shaft is configured to provide an extended height of the tee shaft from the tee base when slid up and positioned under the connecting hole.

6. The indoor golf tee according to claim 4, wherein:

the shaft bottom portion including a positioning groove, the positioning groove is configured to provide a set height of the tee shaft from the tee base when the connecting hole of the tee base is positioned in the positioning groove; and a distal end of the shaft bottom portion including a protruding bottom surface with a bottom radius bigger than a body radius of the shaft body, the protruding bottom surface of the tee shaft is configured to provide an extended height of the tee shaft from the tee base when slid up and positioned under the connecting hole;

whereby, the height of the tee shaft is adjustable between the set height and the extended height.

7. The indoor golf tee according to claim 6 including an incremental distance between the set height and the extended height, the incremental distance is equal to 0.25 inches.

8. The indoor golf tee according to claim 7, wherein the height of the tee shaft is sized between 0.75 inches up to 2.75 inches in 0.25 inch increments, wherein the tee shaft of the indoor golf tee is selected from a group consisting of:

a number 3 shaft that is adjustable between the set height of 0.75 inches and the extended height of 1.00 inches;

a number 4 shaft that is adjustable between the set height of 1.00 inches and the extended height of 1.25 inches;

a number 5 shaft that is adjustable between the set height of 1.25 inches and the extended height of 1.50 inches;

a number 6 shaft that is adjustable between the set height of 1.50 inches and the extended height of 1.75 inches;

a number 7 shaft that is adjustable between the set height of 1.75 inches and the extended height of 2.00 inches;

a number 8 shaft that is adjustable between the set height of 2.00 inches and the extended height of 2.25 inches;

a number 9 shaft that is adjustable between the set height of 2.25 inches and the extended height of 2.50 inches; and a number X shaft that is adjustable between the set height of 2.50 inches and the extended height of 2.75 inches.

9. The indoor golf tee according to claim 1, wherein the tee base having a conical shape with an open top being the connecting hole, wherein the base bottom portion is a rounded flat portion that is larger than the base top portion with the connecting hole, where the tee base tapers smaller from the base bottom portion to the base top portion; and wherein the tee base includes a base height from the base bottom portion to the base top portion.

10. The indoor golf tee according to claim 9, wherein the tee base is selected from a group consisting of: a standard tee base with a standard base height of 0.5 inches;

and a low-profile tee base with a low base height of 0.25 inches.

11. The indoor golf tee according to claim 1, wherein the attachment mechanism is attached to the base bottom portion of the tee base for attaching the weighted bag to the tee base.

12. The indoor golf tee according to claim 1, wherein the attachment mechanism including a lanyard, where the weighted bag is attached to the indoor golf tee via the lanyard;

the lanyard including a swiveled connection between the weighted bag and the indoor golf tee, the swiveled connection is configured to prevent the lanyard from twisting;

the lanyard is connected to the weighted bag via a D-ring connector attached on a corner of the weighted bag; and wherein, when the weighted bag is attached to the indoor golf tee via the lanyard, the weighted bag is configured to prevent the indoor golf tee from being hit farther away from the weighted bag than a length of the lanyard.

13. The indoor golf tee according to claim 1 being a 2-part tee where the tee base is configured to be assembled with the tee shaft for creating the 2-part tee;

wherein the indoor golf tee is configured to allow the tee shaft to be interchanged with the tee base; and whereby the indoor golf tee can be configured with various sized tee shafts or various sized tee bases, or the indoor golf tee can be configured to replace a broken tee shaft by connecting another tee shaft with the tee base.

14. The indoor golf tee according to claim 1, wherein the tee shaft is smaller than the golf ball, whereby the indoor golf tee is designed and configured not to interfere with a golf club before impact.

15. An indoor golf tee comprising:

a tee base;

a tee shaft connected to the tee base and configured to hold a golf ball thereon; and an attachment mechanism configured to attach a weighted bag to the indoor golf tee, wherein the attachment mechanism including a lanyard;

the weighted bag is attached to the indoor golf tee via the lanyard, the lanyard including a swiveled connection between the weighted bag and the indoor golf tee, the swiveled connection is configured to prevent the lanyard from twisting;

the lanyard is connected to the weighted bag via a D-ring connector attached on a corner of the weighted bag; and wherein, when the weighted bag is attached to the indoor golf tee via the lanyard, the weighted bag is configured to prevent the indoor golf tee from being hit farther away from the weighted bag than a length of the lanyard.

16. The indoor golf tee according to claim 15, wherein the attachment mechanism including:

a stem attached to the indoor golf tee at a first end;

a diamond attachment portion on a second end of the stem, the diamond attachment portion is configured for connecting the lanyard between the indoor golf tee and the weighted bag, wherein the diamond attachment portion including:

a first slit on a first side of the diamond attachment portion; and a second slit on a second side of the diamond attachment portion;

wherein, when a looped end of the lanyard is looped around the diamond attachment portion and onto the stem and then pulled over the diamond attachment portion, a first side piece is configured to compress to allow the looped end to enter the first slit on the first side of the diamond attachment portion, and a second side piece is configured to compress to allow the looped end to enter the second slit on the second side of the diamond attachment portion.

* * * * *